US006055702A

United States Patent [19]

Imamura et al.

[11] Patent Number: 6,055,702

[45] Date of Patent: May 2, 2000

[54] VACUUM CLEANER

[75] Inventors: Nobuo Imamura; Jun Yoshikawa, both of Kyoto, Japan

[73] Assignee: Yashima Electric Co., Ltd., Kyoto, Japan

[21] Appl. No.: 09/150,027

[22] Filed: Sep. 9, 1998

[51] Int. Cl.[7] ..... A47L 9/28

[52] U.S. Cl. ..... 15/339; 15/319

[58] Field of Search ..... 15/319, 339

[56] References Cited

U.S. PATENT DOCUMENTS

| | | | |
|---|---|---|---|
| 4,601,082 | 7/1986 | Kurz . | |
| 4,680,827 | 7/1987 | Hummel . | |
| 4,920,605 | 5/1990 | Takashima . | |
| 5,163,202 | 11/1992 | Kawakami et al. | 15/339 X |
| 5,182,833 | 2/1993 | Yamaguchi et al. | 15/319 |
| 5,233,682 | 8/1993 | Abe et al. | 15/319 X |
| 5,251,358 | 10/1993 | Moro et al. | 15/319 |
| 5,319,827 | 6/1994 | Yang | 15/339 X |
| 5,323,483 | 6/1994 | Baeg . | |
| 5,404,612 | 4/1995 | Ishikawa . | |
| 5,515,572 | 5/1996 | Hoekstra et al. | 15/319 |
| 5,572,767 | 11/1996 | Ishikawa . | |
| 5,815,884 | 10/1998 | Imamura et al. | 15/319 X |
| 5,819,367 | 10/1998 | Imamura . | |

FOREIGN PATENT DOCUMENTS

| | | | |
|---|---|---|---|
| 0 546 620 | 12/1992 | European Pat. Off. . | |
| 0 584 743 | 8/1993 | European Pat. Off. . | |
| 584743 | 3/1994 | European Pat. Off. | 15/319 |
| 4122339 | 4/1992 | Japan | 15/319 |
| 7250794 | 10/1995 | Japan . | |

*Primary Examiner*—Chris K. Moore
*Attorney, Agent, or Firm*—Smith, Gambrell & Russell, LLP

[57] ABSTRACT

A vacuum cleaner includes an optical dust sensor for detecting a quantity of dust which sensor is provided at a predetermined position of a suction path for sucking air by a suction force of the vacuum cleaner, whereby an output signal is supplied to a display device so that a display corresponding to the quantity of the sucked dust, which signal is output from the optical dust sensor and is varied in a stageless manner corresponding to the quantity of the dust.

9 Claims, 13 Drawing Sheets

VACUUM CLEANER

BACKGROUND OF THE INVENTION

The present invention relates to a vacuum cleaner, and more particularly to a vacuum cleaner which detects a quantity of dust and visually displays the detected quantity of dust.

In the past, a vacuum cleaner has been strongly demanded for improving its functions similarly to other electrified products. It is proposed and is realized to respond to the demand for improving its functions, that a dust sensor be provided to a vacuum cleaner. Specifically, a dust sensor for detecting a quantity of suctioned dust is provided at a predetermined position of a suction path, and a detection output of the dust sensor, that is the quantity of dust, is displayed in two stages (refer to U.S. Pat. No. 4,601,082).

When the vacuum cleaner having this arrangement is employee, a quantity of dust included within air suctioned through the suction path is detected during an operating period of the vacuum cleaner, and it is displayed whether the quantity of dust is great or small (including a case in which the quantity of dust is zero).

But, dust includes dust of various shapes and sizes such as small sized particles, comparatively large sized particles, cotton dust and others. And, these various dust types vary their percentages depending upon the place to be cleaned. It is almost impossible to determine which kind of dust has the greatest percentage and how much is the greatest percentage.

Therefore, a disadvantage may arise in that the display is made to show a great quantity of dust even when the quantity of dust is small in actuality, depending upon the shape and size of the dust, for example. That is, a detection output of a dust sensor is compared with a predetermined threshold value, and the result is displayed depending upon a relationship in size between the detection output and the threshold value whether the quantity of dust is great or small, for displaying a quantity of dust by two stages. Consequently, the above disadvantage may arise.

Further, it may be thought to vary the threshold value in correspondence to a shape and size of dust, but another disadvantage arises in that an operation for varying the threshold value is needed. And, when an operator forgets the operation, the above disadvantage occurs. Furthermore, a further disadvantage arises in that an extra operation for determining plural threshold values is required, which values are to be selected by an operator.

Further, an extra power supply is needed for performing detection of a quantity of dust by a dust sensor, comparison of a detection output and a predetermined threshold value, and display based upon the comparison result. And, a dry battery is generally employed as the power supply. A yet further disadvantage arises in that the dry battery must be exchanged for a new dry battery. Furthermore, when an operator forgets to exchange the dry battery, it is impossible to perform detection and display of a quantity of dust.

The present invention was made in view of the above problems.

It is an object of the present invention to display a quantity of dust in a stageless manner from a zero condition, that is, the display is varied continuously depending upon a continuous variation of a quantity of dust.

SUMMARY OF THE INVENTION

A vacuum cleaner according to the present invention is a vacuum cleaner which generates a suction force by driving a motor provided within a vacuum cleaner body, and suctions dust with air through an air suction path member connected to the vacuum cleaner body. And, the vacuum cleaner comprises an optical dust sensor for optically detecting a quantity of dust which sensor is provided at a predetermined position of the air suction path member, and a display device driven by an output from the optical dust sensor in a stageless manner.

When the vacuum cleaner having the arrangement is employed, a quantity of dust is optically detected which is suctioned in with air, and a display is driven in a stageless manner based upon an output from the optical dust sensor. Therefore, a decrease in the quantity of dust is displayed in a stageless manner following a cleaning operation. And, no threshold values are needed, and the above disadvantages due to the necessity of threshold values are prevented from occurring, because the decrease in the quantity of dust is displayed in a stageless manner.

It is preferable that a vacuum cleaner according to the present invention employs a fan driven by a suction force and an electric generator driven by the fan as a power source for driving the optical dust sensor, the display and the like.

When the vacuum cleaner is employed, the above disadvantages are prevented from occurring which disadvantages arise when a dry battery is employed as a power source.

BRIEF DESCRIPTION OF PREFERRED EMBODIMENTS

Figure 1:
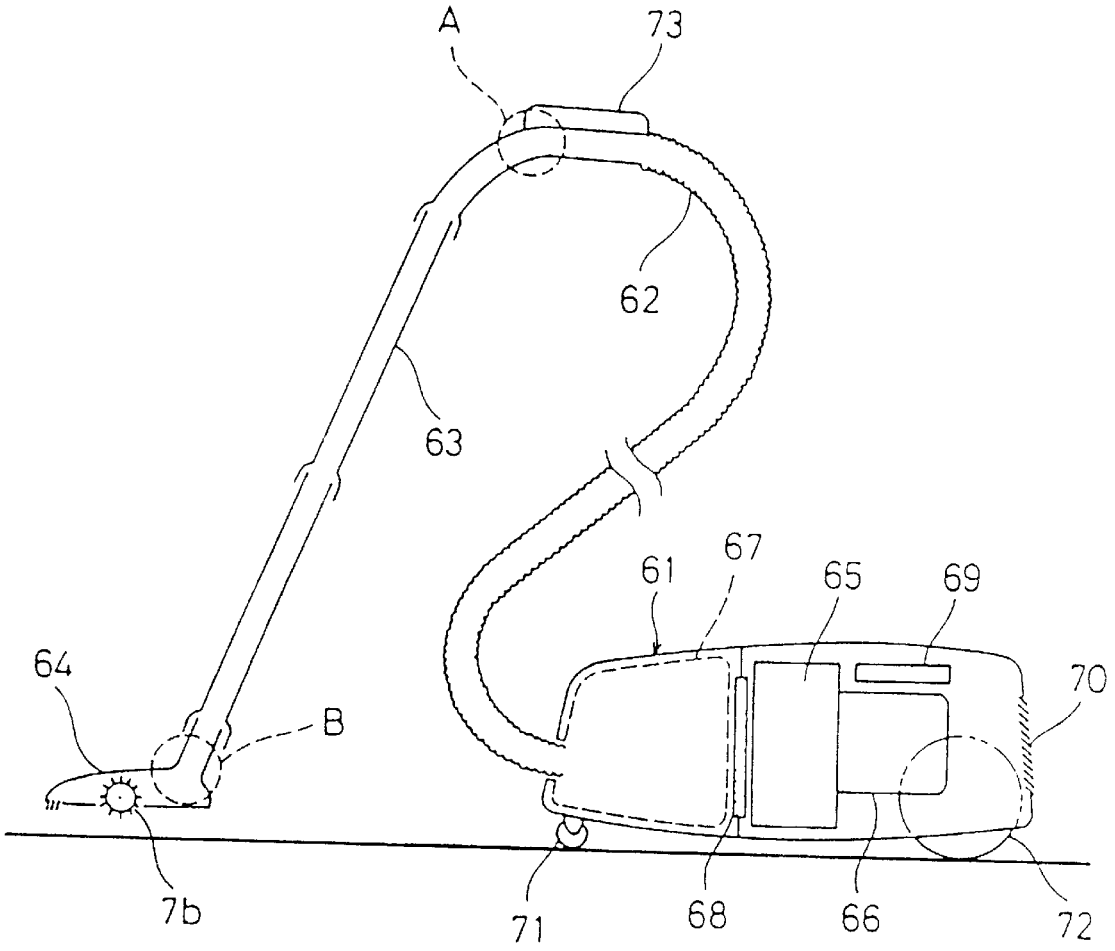
FIG. 1 is a diagram schematically showing an arrangement of a vacuum cleaner according to the present invention.

FIG. 1 is a diagram schematically showing an arrangement of a vacuum cleaner according to the present invention.

The vacuum cleaner comprises a vacuum cleaner body 61, a hose 62 having a bellows shape, an extension pipe 63 connected to a leading edge section of the hose 62 in a removable manner, and a floor nozzle 64 provided at a leading edge section of the extension pipe 63.

The vacuum cleaner body 61 includes a suction fan 65, a motor 66 for driving the suction fan 65, a dust bag 67 for collecting suctioned dust, a filter 68 for collecting fine dust which is not collected by the dust bag 67, a motor control section 69 for controlling the motor 66 to cause varying of the suction force, an exhaust opening 70, a caster 71, and wheels 72.

Figure 2:
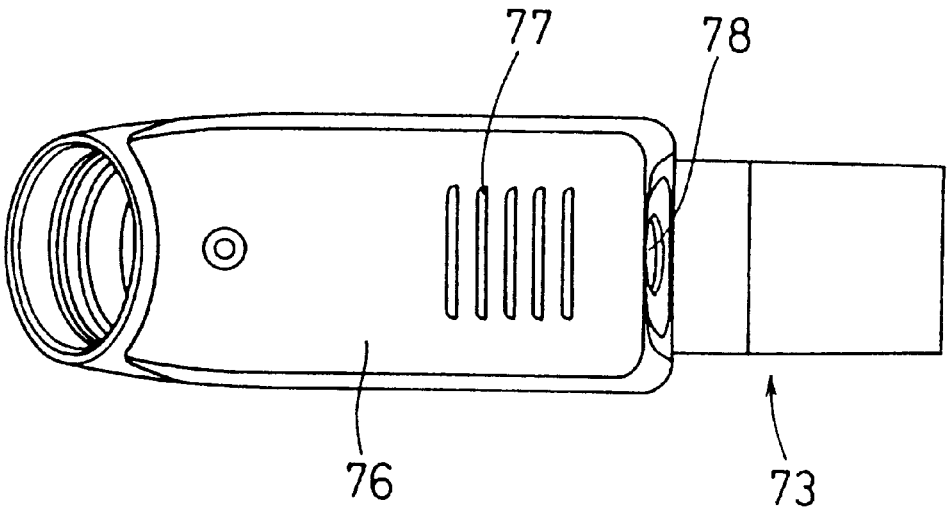
FIG. 2 is a plan view showing a floor nozzle pipe and a cover member.
Figure 3:
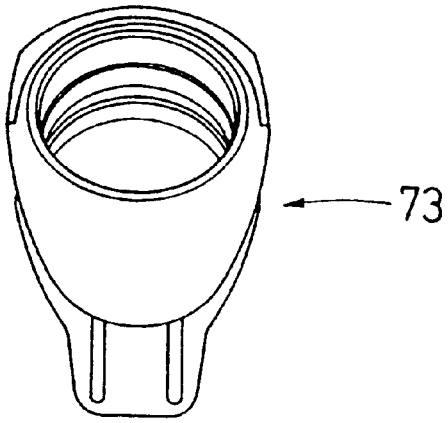
FIG. 3 is a front view showing a floor nozzle pipe and a cover member.
Figure 4:
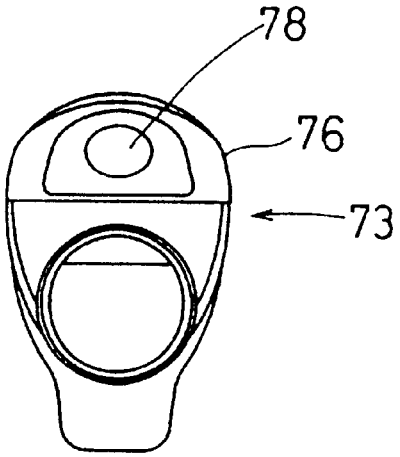
FIG. 4 is a side view showing a floor nozzle pipe and a cover member.

The vacuum cleaner also includes a floor nozzle pipe 73 for connecting the hose 62 to the extension pipe 63. The floor nozzle pipe 73 includes a non-inclined section 74 and an inclined section 75, as is illustrated in FIGS. 2 through 4. Thus, the floor nozzle pipe 73 enables the floor nozzle 64 to lie easily on a floor without a forced posture of an operator when the operator performs cleaning by grasping the extension pipe 63, for example. Further, the floor nozzle pipe 73 includes a cover member 76 which bridges across the non-inclined section 74 and the inclined section 75. The cover member 76 includes therein an electrical circuitry for detecting and visually displaying a quantity of suctioned dust, and includes a suction opening 77 and a display section 78.

Figure 5:
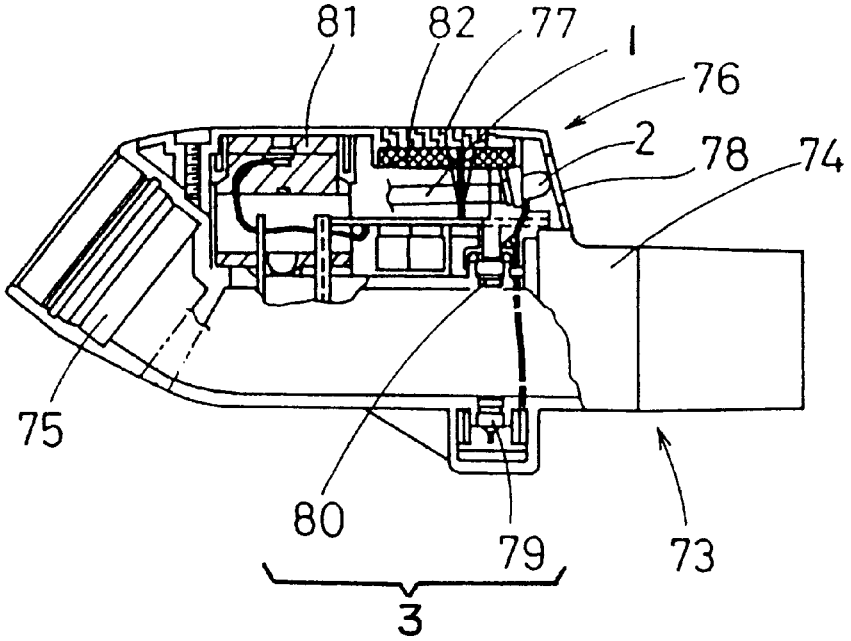
FIG. 5 is a vertical cross sectional view showing an interior arrangement of a floor nozzle pipe and a cover member.

FIG. 5 is a vertical cross sectional view showing an interior arrangement of the floor nozzle pipe 73 and the cover member 76.

The floor nozzle pipe 73 includes a light emitting device 79 such as a light emitting diode or the like and a light receiving device 80 such as a phototransistor or the like (the light emitting device 79 and the light receiving device 80 form a dust sensor 3). The light emitting device 79 and the light receiving device 80 are opposite to one another in a direction which crosses an air flowing direction within the floor nozzle pipe 73 by a right angle. A light radiation face of the light emitting device 79 and a light receiving face of the light receiving device 80 are determined to be almost the same height with an inner face of the floor nozzle pipe 73. Therefore, a quantity of light which reaches the light receiving device 80 among radiated light from the light emitting device 79, is decreased by dust included within an air flow so that the quantity of dust is detected based upon an output signal from the light receiving device 80.

The cover member 76 includes therein a dust sensor circuitry section 81 for performing processing based upon an output signal from the dust sensor 3, a rotatable turbine wheel 82 provided at a position which is close to a suction opening 77, a d.c. electric generator 1 driven by the rotatable turbine wheel 82, and a display device 2 such as a light emitting diode or the like which is driven based upon an output signal from the dust sensor circuitry section 81.

Figure 6:
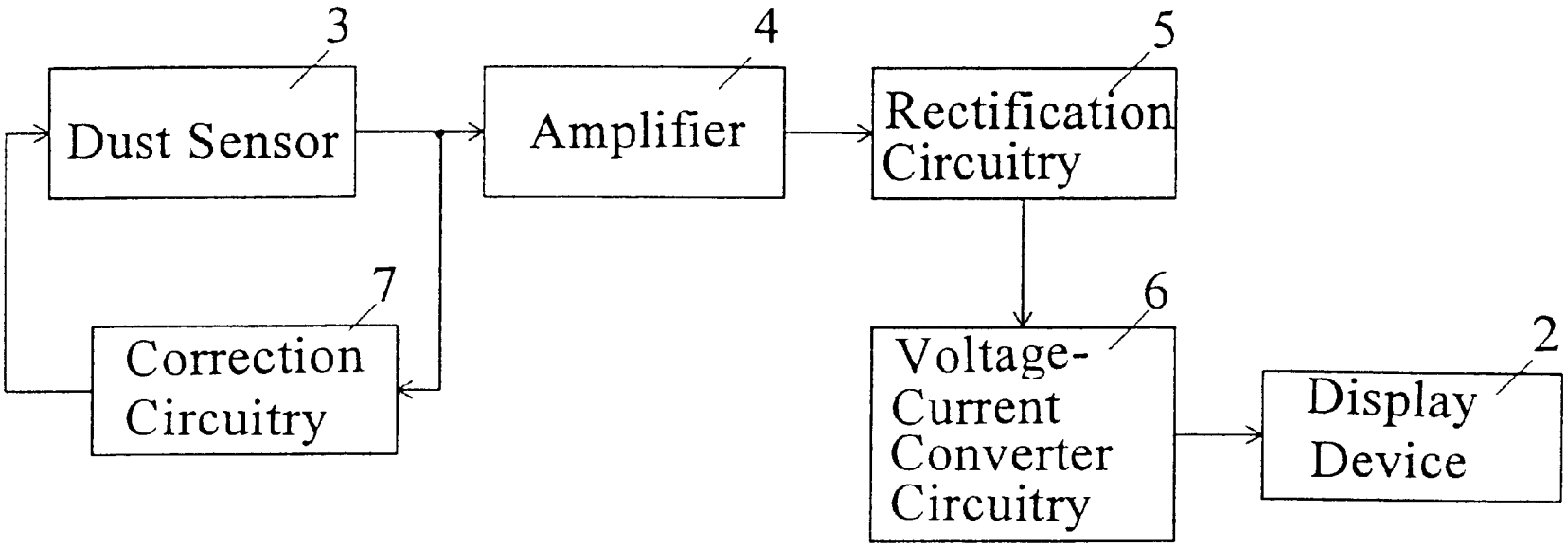
FIG. 6 is a block diagram showing an electrical arrangement of a main portion of a vacuum cleaner according to the present invention.

FIG. 6 is a block diagram showing an electrical arrangement of a main portion of a vacuum cleaner according to the present invention.

As is illustrated in FIG. 6, a dust detection and display apparatus of a vacuum cleaner according to the present invention amplifies an output signal from the dust sensor 3 using an amplifier 4, then obtains a d.c. voltage using rectification circuitry 5, converts the d.c. voltage into a d.c. current using voltage-current converter circuitry (driving circuitry) 6, and thereafter supplies the converted d.c. current to the display device 2. Then, the dust detection and display apparatus feeds back an output signal from correction circuitry 7 to the dust sensor 3, the correction circuitry 7 being input the output signal from the dust sensor 3, so that a quantity of radiating light of the light emitting device 79 of the dust sensor 3 is stabilized. Therefore, a misoperation due to varying of a quantity of radiating light is prevented from occurring. Further, a d.c. electric generator 1 is provided for supplying an operation voltage to the dust sensor 3, amplifier 4, voltage-current converter circuitry 6, and display device 2, the d.c. electric generator 1 not being illustrated in FIG. 6.

Figure 7:
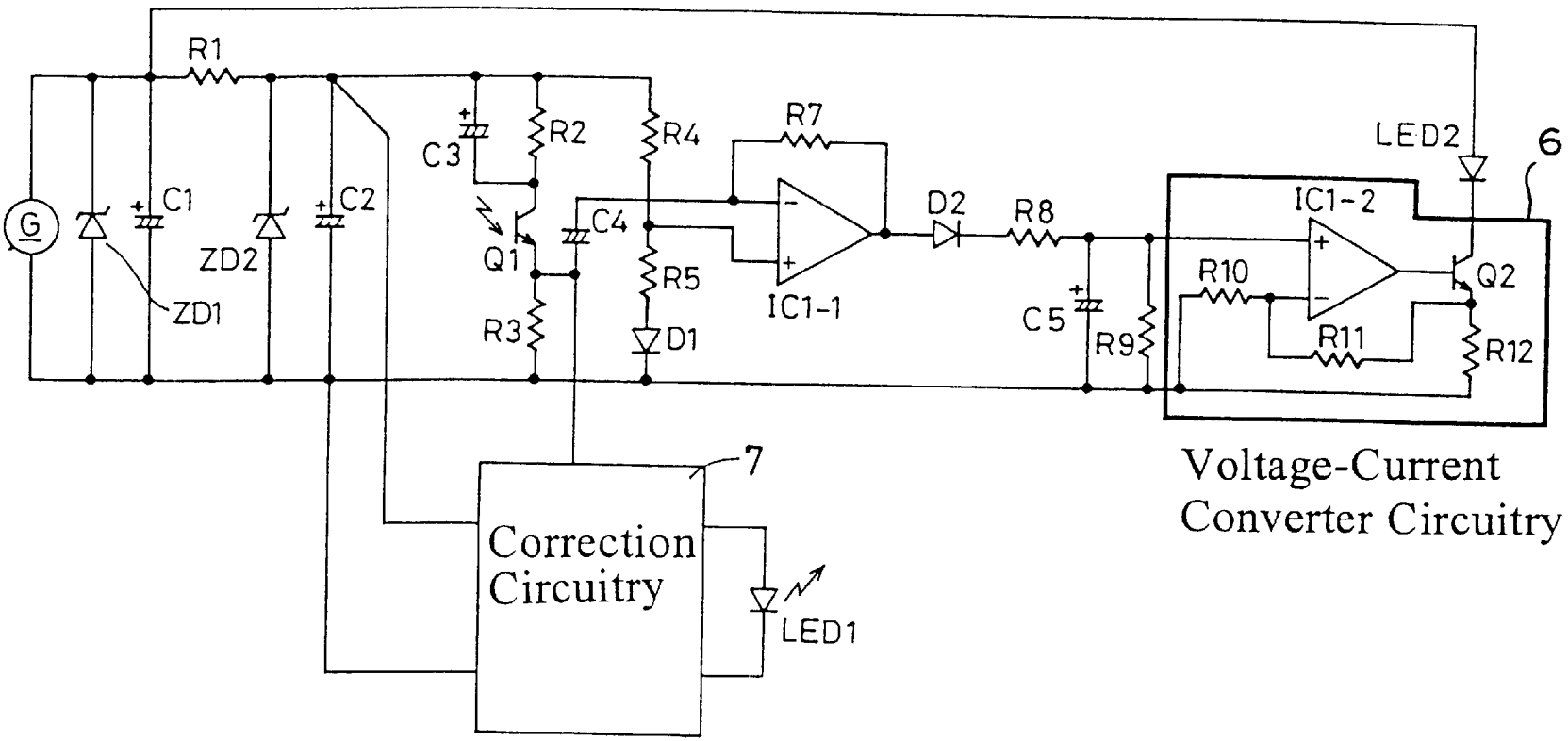
FIG. 7 is an electrical circuit diagram showing the arrangement in FIG. 6 in more detail.

FIG. 7 is an electrical circuit diagram showing the arrangement in FIG. 6 in more detail.

A Zener diode ZD1 and a capacitor C1 are connected in parallel between both terminals of the d.c. electric generator 1. A Zener diode ZD2 and a capacitor C2 are connected in parallel between both terminals of the d.c. electric generator 1 through a resistor R1. A resistor R2, a phototransistor Q1 as the light receiving device 80, and a resistor R3 are connected serially between both terminals of the capacitor C2. A capacitor C3 is connected in parallel to the resistor R2. The correction circuitry 7 is connected between both terminals of the capacitor C2. The correction circuitry 7 is supplied a voltage which is a voltage at a connecting point of the phototransistor Q1 and the resistor R3. A light emitting diode LED1 is connected between output terminals of the correction circuitry 7.

Further, a resistor R4, a resistor R5, and a diode D1 are connected in series between both terminals of the capacitor C2. A connecting point of the resistors R4 and R5 is connected to a non-reversed input terminal of an operational amplifier IC1-1, and a connecting point of the phototransistor Q1 and the resistor R3 is connected to a reversed input terminal of the operational amplifier IC1-1 through a capacitor C4. A resistor R7 is connected between the non-reversed input terminal and an output terminal of the operational amplifier IC1-1.

A diode D2 and a resistor R8 are connected in series to the output terminal of the operational amplifier IC1-1, and a capacitor C5 and a resistor R9 are connected in parallel between the resistor R8 and a negative output terminal of the d.c. electric generator 1.

Furthermore, a connecting point of the resistor R8 and the capacitor C5 is connected to a non-reversed input terminal of an operational amplifier IC 1-2, while the negative output terminal of the d.c. electric generator 1 is connected to a reversed input terminal of the operational amplifier IC 1-2 through a resistor R10. An output terminal of the operational amplifier IC1-2 is connected to a base terminal of a transistor Q2. And, a light emitting diode LED2 is connected between a positive output terminal of the d.c. electric generator 1 and a collector terminal of the transistor Q2. A resistor R12 is connected between the negative output terminal of the d.c. electric generator 1 and an emitter terminal of the transistor Q2. A resistor R11 is connected between the reversed input terminal of the operational amplifier IC1-2 and the emitter terminal of the transistor Q2.

When the dust detection and display apparatus having the above arrangement is employed, a light radiated from the light emitting device 79 is received by the light receiving device 80. An output signal from the light receiving device 80 (i.e., the voltage at the connecting point of the phototransistor Q1 and the resistor R3) is amplified by the operational amplifier IC1-1, then rectified by the diode D2. Thereafter, the d.c. voltage is converted into a d.c. current by the voltage-current converter circuitry 6. The converted d.c. current is supplied to the display device 2 (i.e., light emitting diode LED1). And, a quantity of light which is received by the light receiving device 80 varies depending upon a quantity of dust included within air which passes through the floor nozzle pipe 73. That is, when the quantity of dust is small, the quantity of received light is great, and when the quantity of dust is great, the quantity of received light is small. Therefore, the output signal corresponds to the quantity of suctioned dust. And, the output signal is supplied to the display device 2 after being processed by the amplifier 4 and the voltage-current converter circuitry 6.

The d.c. current supplied to the display device 2 is not processed based upon a threshold value at all, and therefore the d.c. current corresponds to the quantity of dust and the d.c. current varies in correspondence to variation of the quantity of dust within the air which passes through the floor nozzle pipe 73. That is, the d.c. current supplied to the display device 2 varies in a stageless manner depending upon the variation in quantity of dust. Consequently, threshold values are not necessarily determined at all, determination of optimum threshold values being difficult and an operation for determining optimum threshold values being extremely complicated. The d.c. current supplied to the display device 2 varies in a stageless manner corresponding to variation in the quantity of dust so that the quantity of dust within air which passes through the floor nozzle pipe 73 is securely displayed whereby, in its turn, it can be displayed that cleaning has finished, despite no threshold values being employed.

Further, when the suction fan 65 of the vacuum cleaner is driven, air is also suctioned through the suction opening 77. The rotatable turbine wheel 82 is rotated by the air suctioned through the suction opening 77. The rotatable turbine wheel 82 then drives the d.c. electric generator 1 so that an operation voltage for the dust detection and display apparatus is generated. Therefore, an operation for exchanging a dry battery with a new one is not necessary at all, which operation is necessary when a dry battery is employed as a power source. Of course, disadvantages due to forgetting of exchanging of a dry battery are prevented from occurring.

Figure 8:
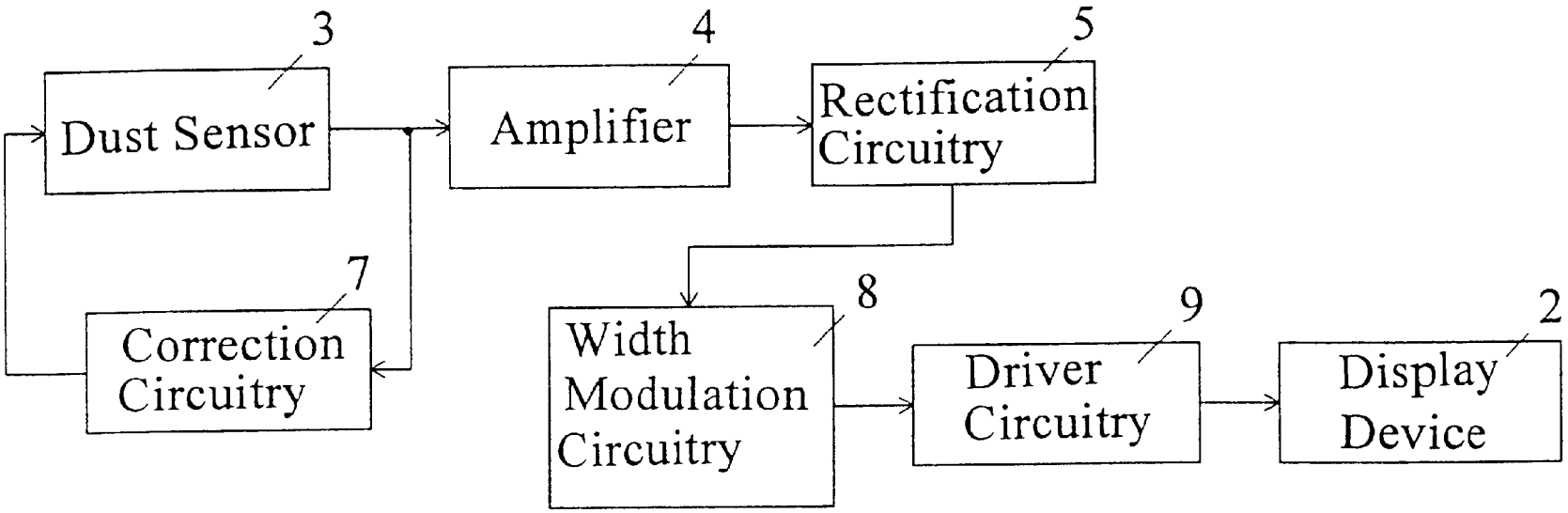
FIG. 8 is a block diagram showing another electrical arrangement of a main portion of a vacuum cleaner according to the present invention.

FIG. 8 is a block diagram showing another electrical arrangement of a main portion of a vacuum cleaner according to the present invention.

A dust detection and display apparatus illustrated in FIG. 8 differs from the dust detection and display apparatus illustrated in FIG. 6 in that pulse width modulation circuitry 8, which receives the output signal from the rectification circuitry 5, and driver circuitry 9, which receives a pulse width modulation signal output from the pulse width modulation circuitry 8, are employed instead of the voltage-current converter circuitry 6.

When the dust detection and display apparatus illustrated in FIG. 8 is employed, the pulse width modulation circuitry 8 performs pulse width modulation in correspondence to an output signal from the rectification circuitry 5 so as to output a pulse width modulation signal. And, the driver circuitry 9 receives the pulse width modulation signal and outputs a driving signal for driving the display device 2 therefrom.

Consequently, similarly to the dust detection and display apparatus illustrated in FIG. 6, threshold values are not necessarily determined at all, and the driving signal supplied to the display device 2 varies in a stageless manner corresponding to variation in the quantity of dust so that a quantity of dust within air which passes through the floor nozzle pipe 73 is securely displayed, in its turn it can be displayed that cleaning has finished, despite no threshold values being employed.

Further, under a condition that the suction fan 65 of the vacuum cleaner is driven, air is also suctioned through the suction opening 77. The rotatable turbine wheel 82 is rotated by air suctioned through the suction opening 77. The rotatable turbine wheel 82 drives the d.c. electric generator 1 so that an operation voltage for the dust detection and display apparatus is generated. Therefore, an operation for exchanging a dry battery with a new one is not necessary at all which operation is necessary when a dry battery is employed as a power source. Of course, disadvantages due to forgetting of exchanging of a dry battery are prevented from occurring.

Figure 9:
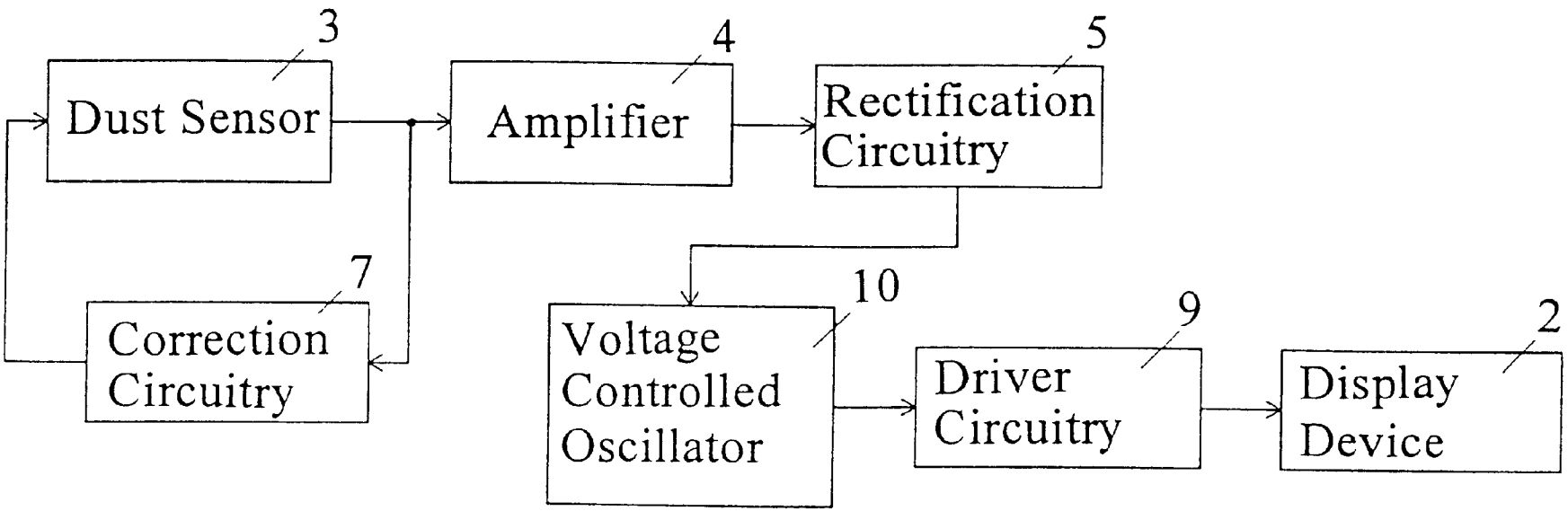
FIG. 9 is a block diagram showing a further electrical arrangement of a main portion of a vacuum cleaner according to the present invention.

FIG. 9 is a block diagram showing a further electrical arrangement of a main portion of a vacuum cleaner according to the present invention.

The dust detection and display apparatus illustrated in FIG. 9 differs from the dust detection and display apparatus illustrated in FIG. 6 in that a voltage controlled oscillator 10, which receives an output signal from the rectification circuitry 5, and driver circuitry 9, which receives an oscillation signal output from the voltage controlled oscillator 10, are employed instead of the voltage-current converter circuitry 6.

When the dust detection and display apparatus illustrated in FIG. 9 is employed, the voltage controlled oscillator 10 performs oscillation in correspondence to an output signal (output voltage) from the rectification circuitry 5 so as to output an oscillation signal, and the driver circuitry 9 receives the oscillation signal and outputs a driving signal for driving the display device 2.

Consequently, similarly to the dust detection and display apparatus illustrated in FIG. 6, threshold values are not necessarily determined at all, and the driving signal supplied to the display device 2 varies in a stageless manner corresponding to variation in the quantity of dust so that the quantity of dust within air which passes through the floor nozzle pipe 73 is securely displayed, and in its turn it can be displayed that cleaning has finished, despite no threshold values being employed.

Further, under a condition that the suction fan 65 of the vacuum cleaner is driven, air is also suctioned through the suction opening 77. The rotatable turbine wheel 82 is rotated by air suctioned through the suction opening 77. The rotatable turbine wheel 82 drives the d.c. electric generator 1 so that an operation voltage for the dust detection and display apparatus is generated. Therefore, an operation for exchanging a dry battery with a new one is not necessary at all which operation is necessary when a dry battery is employed as a power source. Of course, disadvantages due to forgetting of exchanging of a dry battery are prevented from occurring.

Figure 10:
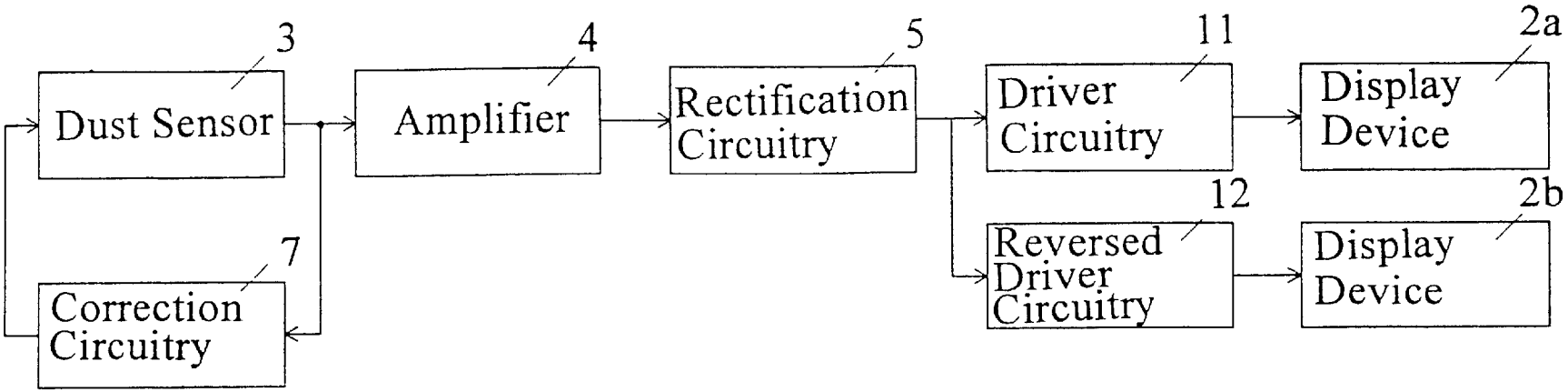
FIG. 10 is a block diagram showing yet another electrical arrangement of a main portion of a vacuum cleaner according to the present invention.

FIG. 10 is a block diagram showing yet another electrical arrangement of a main portion of a vacuum cleaner according to the present invention.

The dust detection and display apparatus illustrated in FIG. 9 differs from the dust detection and display apparatus illustrated in FIG. 6 in that driver circuitry 11 and reversed driver circuitry 12, which both receive an output signal from the rectification circuitry 5, are employed instead of the voltage-current converter circuitry 6, and in that a display device 2*a* driven by the driver circuitry 11 and a display device 2*b* driven by the reversed driver circuitry 12 are employed instead of the display device 2.

Figure 15:
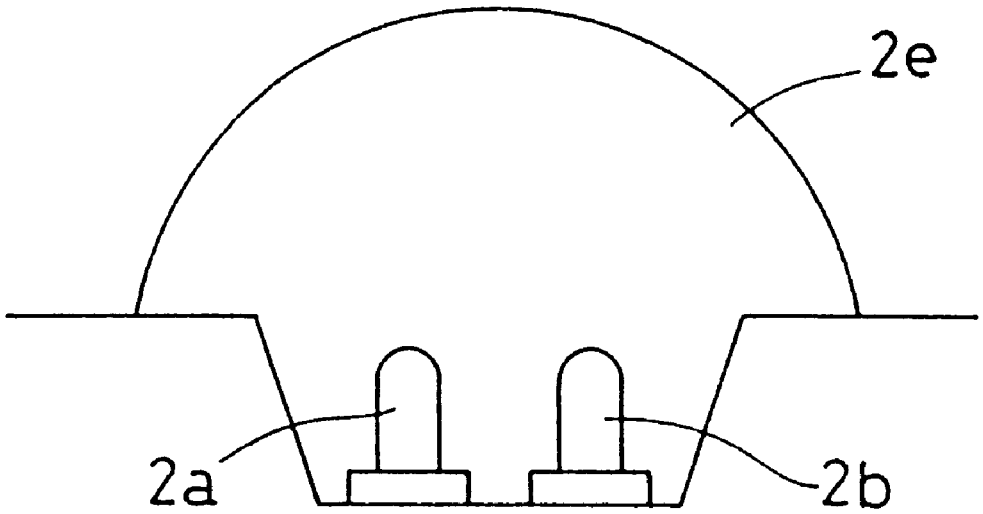
FIG. 15 is a vertical cross sectional view schematically showing an arrangement of a display device.

When the dust detection and display apparatus illustrated in FIG. 10 is employed, an output signal from the rectification circuitry 5 is simultaneously supplied to the driver circuitry 11 and the reversed driver circuitry 12. The driver circuitry 11 outputs a signal so as to drive the display device 2*a* which signal is in proportion to the output signal from the rectification circuitry 5, and the reversed driver circuitry 12 outputs a signal so as to drive the display device 2*b* which signal is in reversed proportion to the output signal from the rectification circuitry 5. In this case, the display device 2*a* and the display device 2*b* are driven by signals which represent reversed variation to one another. Therefore, when a quantity of dust is increased, for example, the display device 2*a* lights brighter, while the display device 2*b* becomes darker. Further, the quantity of dust can be displayed as a variation in color by determining the display color of the display device 2*a* and the display color of the display device 2*b*, both colors being different from one another, and by providing both display devices 2*a* and 2*b* within a single mold 2*e* as is illustrated in FIG. 15.

Consequently, similarly to the dust detection and display apparatus illustrated in FIG. 6, threshold values are not necessarily determined at all, and the driving signals supplied to the display devices 2*a* and 2*b* vary in a stageless manner corresponding to the variation in the quantity of dust so that the quantity of dust within the air which passes through the floor nozzle pipe 73 is securely displayed, and in its turn it can be displayed that cleaning has finished, despite no threshold values being employed.

Further, under the condition that the suction fan 65 of the vacuum cleaner is driven, air is also suctioned through the suction opening 77. The rotatable turbine wheel 82 is rotated by the air suctioned through the suction opening 77. The rotatable turbine wheel 82 drives the d.c. electric generator 1 so that an operation voltage for the dust detection and display apparatus is generated. Therefore, an operation for exchanging a dry battery with a new one is not necessary at all which operation is necessary when a dry battery is employed as a power source. Of course, disadvantages due to forgetting of exchanging of a dry battery are prevented from occurring.

Figure 11:
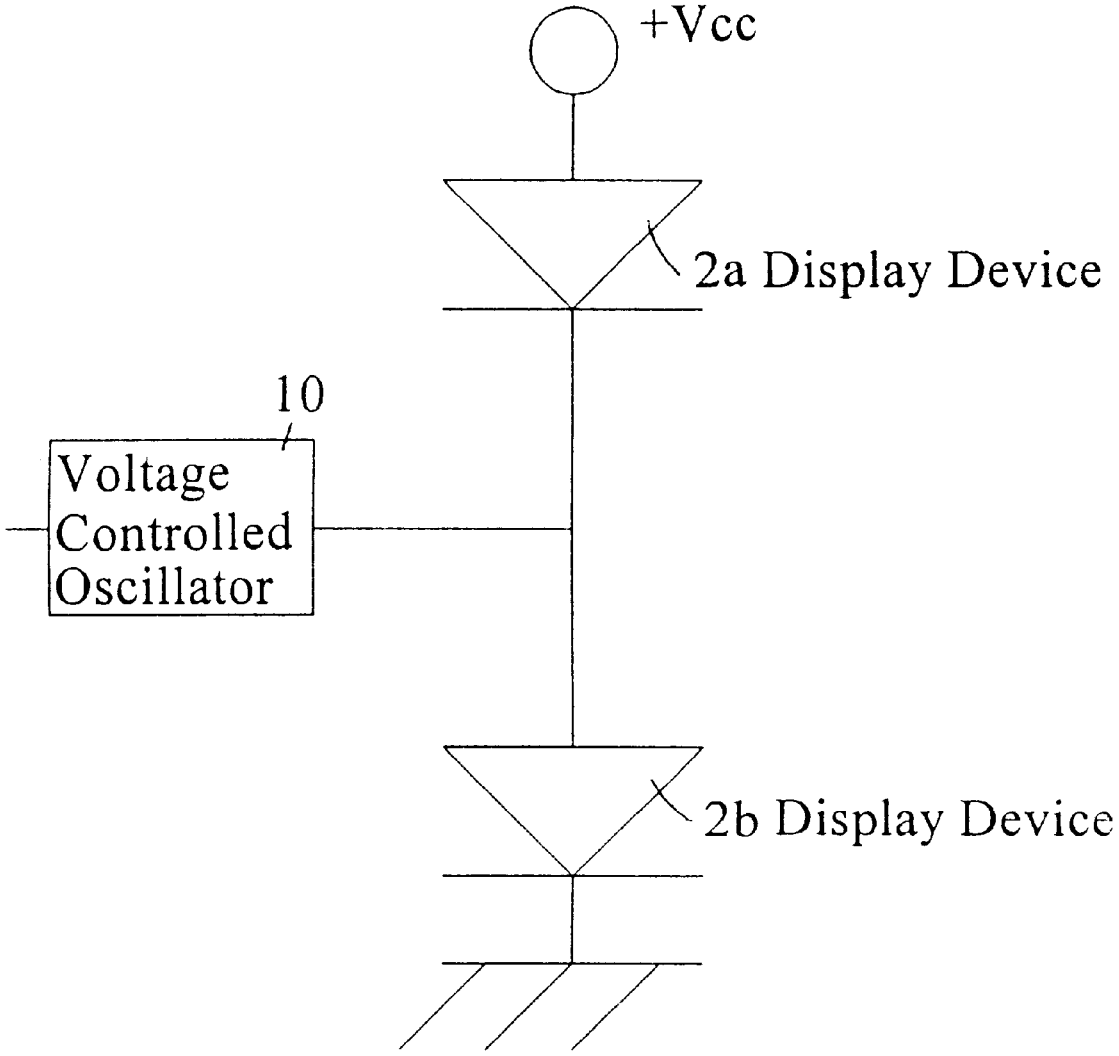
FIG. 11 is a block diagram of a main portion of a dust detection and display apparatus of a modified example of the invention.

FIG. 11 is a block diagram of a main portion of a dust detection and display apparatus of a modified example.

In the dust detection and display apparatus, the display devices 2*a* and 2*b* are connected in series to one another, and an output signal from a driver circuitry 10 which receives an output signal from the rectification circuitry 5 is supplied to a connecting point of the display device 2*a* and the display device 2*b*.

When the dust detection and display apparatus illustrated in FIG. 11 is employed, simplification in arrangement following omission of reversed driver circuitry 12 is performed in comparison to the dust detection and display apparatus illustrated in FIG. 10. And, the dust detection and display apparatus illustrated in FIG. 11 performs similarly to that of the dust detection and display apparatus illustrated in FIG. 10.

Figure 12:
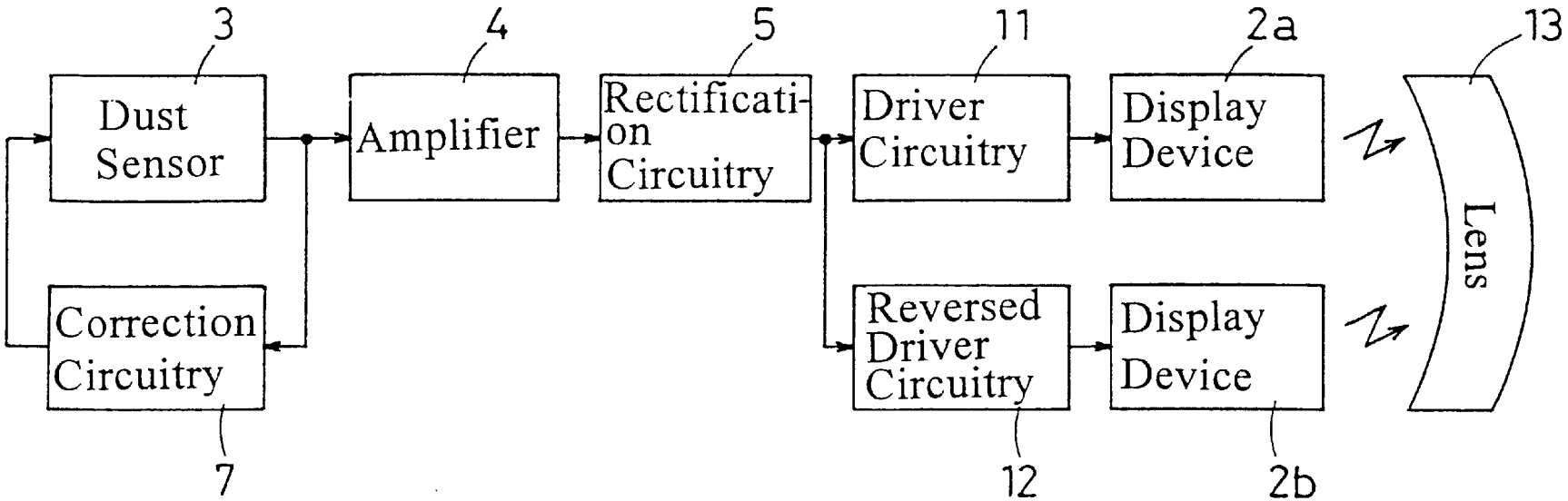
FIG. 12 is a block diagram showing yet another electrical arrangement of a main portion of a vacuum cleaner according to the present invention.

FIG. 12 is a block diagram showing yet another electrical arrangement of a main portion of a vacuum cleaner according to the present invention.

The dust detection and display apparatus illustrated in FIG. 12 differs from the dust detection and display apparatus illustrated in FIG. 10 in that a lens 13 is further provided for mixing a display of the display device 2*a* and a display of the display device 2*b*.

When the dust detection and display apparatus illustrated in FIG. 12 is employed, simple display devices can be employed as the display device 2*a* and the display device 2*b*, respectively. Therefore, freedom in selecting a display device is improved. And, the dust detection and display apparatus illustrated in FIG. 12 performs a similar operation to that of the dust detection and display apparatus illustrated in FIG. 10.

Figure 13:
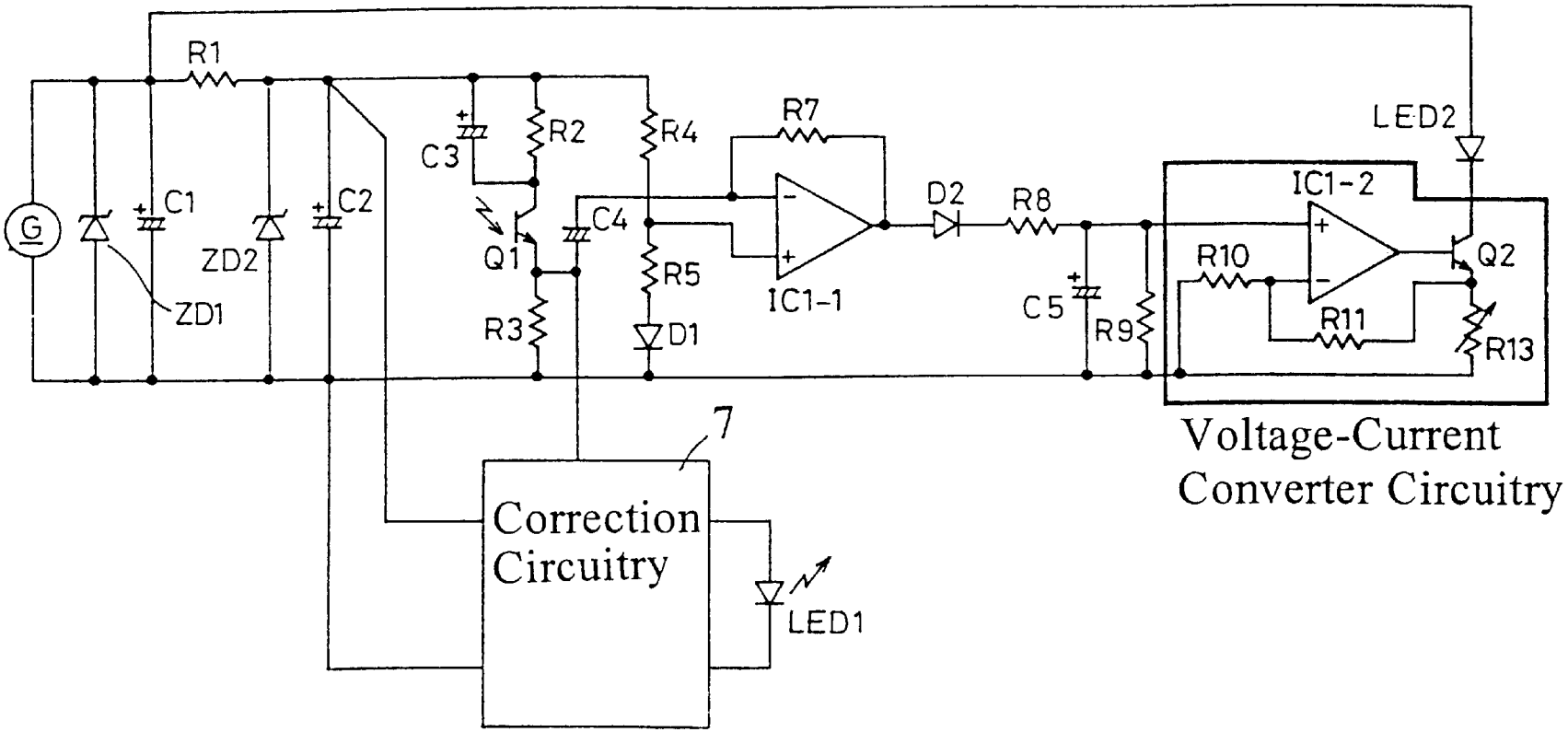
FIG. 13 is an electrical circuit diagram showing in more detail the dust detection and display apparatus illustrated in FIG. 6.

FIG. 13 is an electrical circuit diagram showing in more detail a dust detection and display apparatus of the type illustrated in FIG. 6.

The electrical circuit diagram illustrated in FIG. 13 differs from the electrical circuit diagram illustrated in FIG. 7 in that a variable resistor R13 is employed instead of the resistor R12 which is connected to the transistor Q2 in series.

The variable resistor R13 may be any type of resistor which can be varied in its resistance value, such as a variable resistor which can be manually varied in its resistance value in a stageless manner, resistance circuitry in which one of a plurality of resistance values previously determined can be manually selected, a resistance device or resistance circuitry which receives a resistance value changing command and varies its resistance value in a stageless manner, a resistance device or resistance circuitry which receives a resistance value changing command and selects one of a plurality of resistance values previously determined, or the like.

When the dust detection and display apparatus illustrated in FIG. 13 is employed, even when a predetermined quantity of dust is detected, a display by the display device 2 is varied brighter or darker in comparison to a display by the dust detection and display apparatus illustrated in FIG. 7 by varying the resistance value of the variable resistor R13. Therefore, a dust detection sensitivity can be adjusted. Consequently, an optimum dust detection sensitivity can be obtained which matches the species of the cleaning location (species such as a board floor, a tatami mat, a carpet and the-like), a suction force of the vacuum cleaner and the like. Of course, the dust detection and display apparatus illustrated in FIG. 13 performs a similar operation to that of the dust detection and display apparatus illustrated in FIG. 7.

Further, a modification similar to the modification illustrated in FIG. 13 (employing of the variable resistor) is applicable to one of the dust detection and display apparatus illustrated in FIG. 8 through FIG. 12.

Furthermore, the dust detection and display apparatus illustrated in FIG. 6 through FIG. 13 are provided to the floor nozzle pipe 73. But, the dust detection and display apparatus illustrated in FIG. 6 through FIG. 13 can be provided at an arbitrary position of a path which suctions air following cleaning, such as a predetermined position of the hose 62 having a bellows shape, a predetermined position of the extension pipe 63 and the like.

Figure 14A:
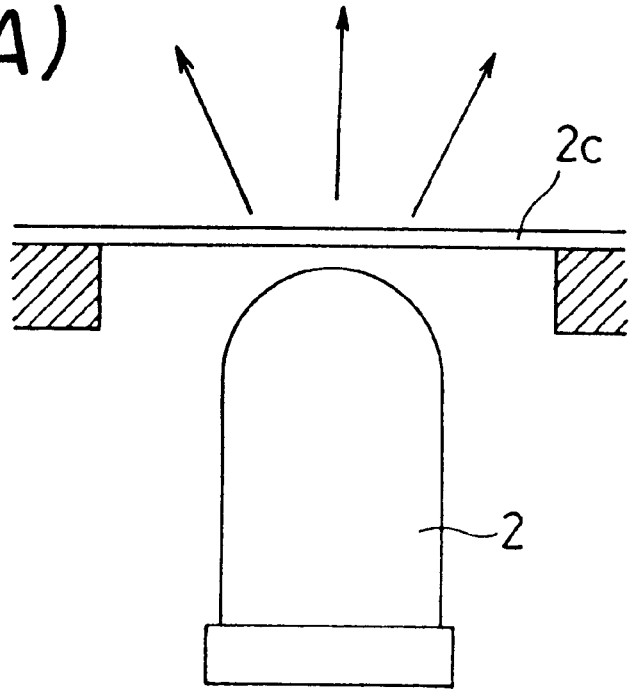
FIGS. 14A and 14B are vertical cross sectional views showing arrangements of a display device.

FIGS. 14(A) and 14(*b*) are vertical cross sectional views showing arrangements of a display device.

In FIG. 14(A), a light emitting diode 2 is employed as the display device 2 and a transparent flat membrane 2*c* is provided at a position which is close to a light emitting face of the light emitting diode 2.

When this arrangement is employed, a display is easily recognized from just above the position of the transparent flat membrane 2*c*.

Figure 14B:
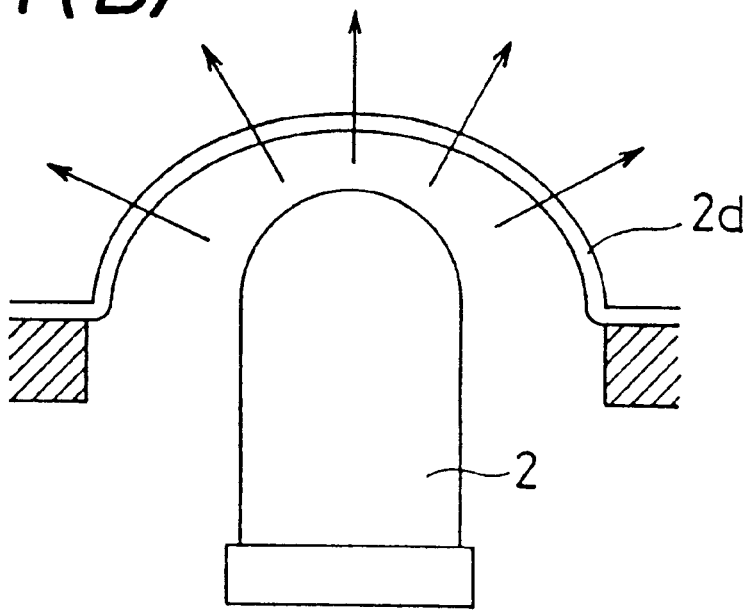

In FIG. 14(B), a light emitting diode 2 is employed as the display device 2 and a transparent curved (projected) membrane 2*d* is provided at a position which is close to a light emitting face of the light emitting diode 2.

When this arrangement is employed, a display is easily recognized not only just above the position of the transparent curved membrane 2*d* but also at a side-ward position of the transparent curved membrane 2*d*.

The present invention is not limited to the attached drawings and the embodiments. Many modifications and variations are possible within the scope of the present invention.

What is claimed is:

1. A vacuum cleaner comprising;

dust suction path means for passing dust and air therethrough by a sucking force;

dust sensor means for optically detecting a quantity of sucking dust and for outputting a detection signal, the dust sensor means being provided at a predetermined position of the dust suction path means;

display means for visually displaying the quantity of detected dust; and display controlling means for receiving the detection signal from the dust sensor means, for outputting and supplying a driving signal to the display means, the driving signal being varied in stageless condition in correspondence to the quantity of dust.

2. A dust indicating system for a vacuum cleaner, comprising:

an optical dust sensor for detecting a quantity of dust suctioned through a suction path of a vacuum cleaner, and for outputting a detecting signal corresponding to an amount of detected dust;

a rectifying circuit for rectifying the detecting signal produced by the optical dust sensor;

a pulse width modulation circuit for producing a pulse width modulation signal in response to the rectified detecting signal;

a driver circuit for producing a driving signal in response to the pulse width modulation signal; and an indicator responsive to the driving signal;

the optical dust sensor, the rectifying circuit, the pulse width modulation circuit, the driver circuit and the indicator operating together such that the driving signal varies continuously in correspondence to the quantity of dust detected by the optical dust sensor.

3. A dust indicating system as recited in claim 2, further including an amplifier for amplifying the detecting signal before rectification by the rectification circuit.

4. A dust indicating system as recited in claim 2, further including a correction circuit for stabilizing an amount of light emitted by the optical dust sensor.

5. A dust indicating system as recited in claim 2, further including an electrical generator for generating a voltage which corresponds to a suction force of a vacuum cleaner.

6. A dust indicating system for a vacuum cleaner, comprising:

an optical dust sensor for detecting a quantity of dust suctioned through a suction path of a vacuum cleaner, and for outputting a detecting signal corresponding to an amount of detected dust;

a rectifying circuit for rectifying the detecting signal produced by the optical dust sensor;

a voltage oscillation circuit for producing an oscillation signal in response to the rectified detecting signal;

a driver circuit for producing a driving signal in response to the oscillation signal; and an indicator responsive to the driving signal;

the optical dust sensor, the rectifying circuit, the voltage oscillation circuit, the driver circuit and the indicator operating together such that the driving signal varies continuously in correspondence to the quantity of dust detected by the optical dust sensor.

7. A dust indicating system as recited in claim 6, further including an amplifier for amplifying the detecting signal before rectification by the rectification circuit.

8. A dust indicating system as recited in claim 6, further including a correction circuit for stabilizing an amount of light emitted by the optical dust sensor.

9. A dust indicating system as recited in claim 6, further including an electrical generator for generating a voltage which corresponds to a suction force of a vacuum cleaner.

* * * * *

UNITED STATES PATENT AND TRADEMARK OFFICE

CERTIFICATE OF CORRECTION

PATENT NO. : 6,055,702
DATED : May 2, 2000
INVENTOR(S) : Nobuo Imamura; Jun Yoshikawa It is certified that error appears in the above-identified patent and that said Letters Patent is hereby corrected as shown below:

In the left hand column of the cover sheet of the issued patent below the filing date information, please insert the following:

--RELATED U.S. APPLICATION DATA
Divisional of Application No. 08/757,164, November 27, 1996, Pat. No. 5,815,884.--

Signed and Sealed this
Tenth Day of April, 2001

*Attest:*

Nicholas P. Godici

NICHOLAS P. GODICI

*Attesting Officer*

*Acting Director of the United States Patent and Trademark Office*